United States Patent [19]

Auer et al.

[11] Patent Number: 4,889,514

[45] Date of Patent: Dec. 26, 1989

[54] BLINKING TOY VEHICLE

[75] Inventors: Robert T. Auer, East Stroudsburg, Pa.; Richard L. Keats, Sands Point, N.Y.; Jore M. Chung, Jackson, N.J.

[73] Assignee: Buddy L Corp., New York, N.Y.

[21] Appl. No.: 269,116

[22] Filed: Nov. 9, 1988

[51] Int. Cl.[4] ..... A63H 27/00; A63H 5/00; A63H 17/28; A63H 33/26

[52] U.S. Cl. ..... 446/230; 446/269; 446/409; 446/439; 446/485

[58] Field of Search ..... 446/230, 231, 232, 269, 446/485, 438, 439, 410, 411, 413

[56] References Cited

U.S. PATENT DOCUMENTS

| | | | |
|---|---|---|---|
| 1,969,407 | 8/1934 | Kingsbury | 446/439 |
| 2,248,883 | 7/1941 | Lehigh | 446/230 |
| 2,734,311 | 2/1956 | Christopher | 446/485 X |
| 2,817,926 | 12/1957 | De Cicco | 446/438 X |
| 3,580,575 | 5/1971 | Speeth | 446/439 X |
| 4,445,297 | 5/1984 | D'Andrade et al. | 446/409 X |

FOREIGN PATENT DOCUMENTS

| | | | |
|---|---|---|---|
| 970891 | 11/1955 | Fed. Rep. of Germany | 446/230 |

*Primary Examiner*—Robert A. Hafer
*Assistant Examiner*—D. Neal Muir
*Attorney, Agent, or Firm*—Michael Ebert

[57] ABSTRACT

A hand-propelled toy airplane, locomotive or other wheeled vehicle for pre-school children having a handle making it possible for a player to push the vehicle along a surface. The vehicle is provided with one or more lights whose bulbs are connected to a battery supply through a handle switch that is actuated only when the player grasps the handle to turn on the lights. Operatively coupled to the axle of a wheel set is an interrupter switch connected in series with the handle switch, the circuit arrangement being such that when the handle switch is actuated, at least one light goes one, and when the vehicle is pushed along the surface, the actuated interrupter switch then causes the lights to turn on intermittently to produce a blinking effect at a rate depending on how fast the vehicle is being propelled. When the handle switch is released by the player, the battery supply is disconnected from the bulbs, so that no power is drained from the supply when the toy is not in use.

9 Claims, 2 Drawing Sheets

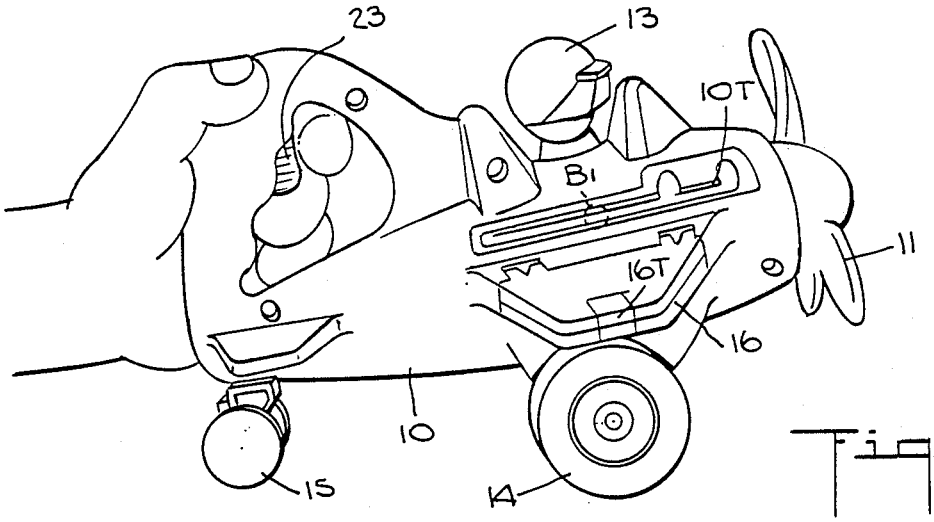
Fig. 1.
Fig. 2.
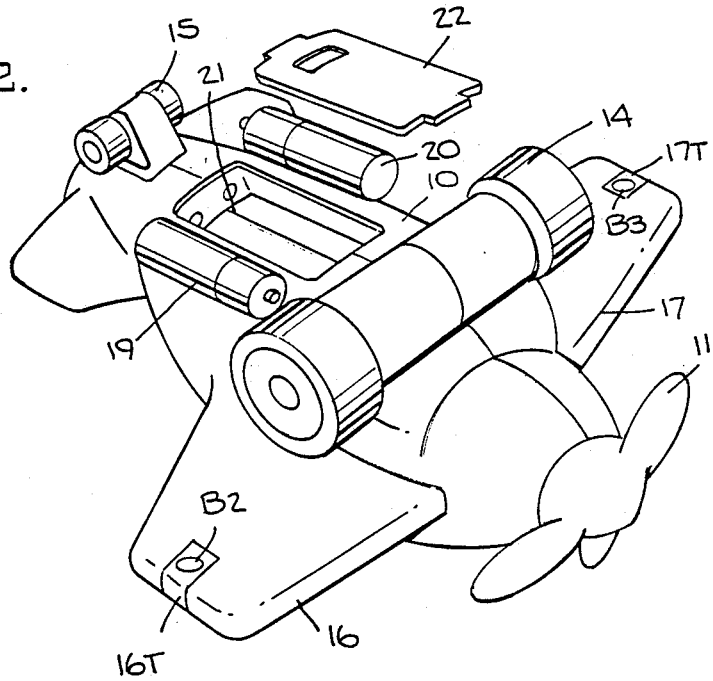
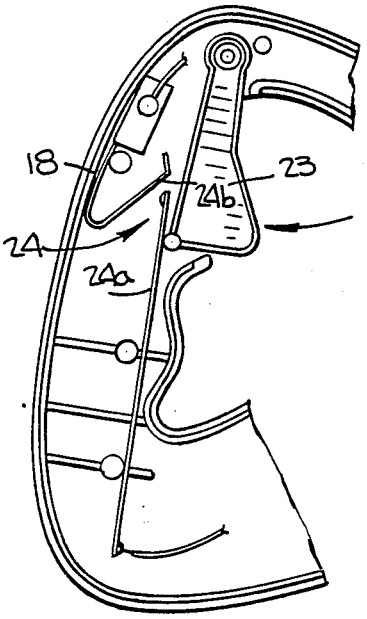
Fig. 3.

BLINKING TOY VEHICLE

BACKGROUND OF INVENTION

1. Field of Invention:

This invention relates generally to toy vehicles, and more particularly to a hand-propelled vehicle provided with lights that are caused to blink at a rate depending on the speed at which the vehicle is propelled.

2. Status of Prior Art:

Toy vehicles appropriate to very young children of preschool age must be very simple, so that the child himself can propel the vehicle and not be required to wind up a spring motor or to carry out some other action that is beyond his capacity. It is for this reason that in some instances a self-propelled toy vehicle, whether in the form of a truck, airplane, bus or other wheeled structure, is provided with a handle, making it possible for the pre-school player to push the vehicle along the ground or a playing surface.

Because play, even at the earliest age, is a learning experience and children seek as best they can to imitate an observed adult activity, the play value of a toy vehicle depends on the extent to which the toy simulates reality and thereby sustains the player's interest.

Thus, a hand-propelled toy vehicle that does nothing more when pushed than move has limited play value; for the child, after pushing the toy for a few minutes, loses interest. What engages a child's interest are basic tactile and sensory experiences associated with reality. Thus, a child relates a real life locomotive not only with movement but with a powerful headlight and engine noises. This is also true of automobiles and other vehicles, all of which have lights and make engine noises of some sort.

SUMMARY OF INVENTION

The main object of this invention is to provide a self-propelled, battery-powered toy vehicle for preschool children which has sustained play interest, the vehicle having lights at least one of which is activated continuously when the player grasps the handle of the toy, which lights are caused to blink only when the handled toy is propelled along a playing surface.

By "playing surface" is meant a floor, a table, or any other surface on which it is possible for the child to propel the toy vehicle.

A significant advantage of the invention is that when the player releases the handle to stop playing with the vehicle, the battery supply is then disconnected from all lights and no power is thereafter drained from the battery supply until the player resumes play by grasping the handle, thereby conserving power and avoiding premature exhaustion of the batteries.

More particularly, an object of this invention is to provide a blinking toy of the above type in which the blinking rate is a function of the effort exerted by the player in propelling the toy vehicle.

Thus, a toy in accordance with the invention is characterized by the fact that two distinct physical actions are required for light activity, one being the squeezing of a handle trigger and the other being the pushing of the toy by the handle, each physical action resulting in a different type of light activity.

Also an object of the invention is to provide a self-propelled toy vehicle of the above type in which the movement of the vehicle is accompanied by sound effects that simulate motor noise and depend on how fast the vehicle is propelled by the player. In playing with the self-propelled toy, the child not only enjoys moving the toy in any desired path, but his action is accompanied by light and sound effects which enhance the play experience and therefore sustain the child's interest.

Yet another object of the invention is to provide a simple, self-propelled toy vehicle which operates reliably and efficiently and can be mass-produced at low cost.

Briefly stated, these objects are attained in a hand- .t propelled toy airplane, locomotive or other wheeled vehicle for pre-school children having a handle making it possible for a player to push the vehicle along a playing surface. The vehicle is provided with one or more lights whose bulbs are connected to a battery supply through a handle switch that is actuated only when the player grasps the handle to turn on the lights.

Operatively coupled to the axle of a wheel set is an interrupter switch connected in series with the handle switch, the circuit arrangement being such that when the handle switch is actuated, at least one light goes on, and when the vehicle is pushed along the playing surface, the actuated interrupter switch then causes the lights to turn on intermittently to produce a blinking effect at a rate depending on how fast the vehicle is being propelled. When the handle switch is released by the player the battery supply is then disconnected from the bulbs so that no power is drained from the supply when the toy is not in use.

BRIEF DESCRIPTION OF DRAWINGS

For a better understanding of the invention as well as other objects and further features thereof, reference is made to the following detailed description to be read in conjunction with the accompanying drawings, wherein:

FIG. 1 shows, in perspective, a first embodiment of a hand-propelled toy vehicle in accordance with the invention in an airplane format in which a fuselage light and wing lights are caused to blink;

FIG. 2 is an underside view of the plane;

FIG. 3 shows the handle switch arrangement for the toy vehicle;

DESCRIPTION OF INVENTION

Figure 5:
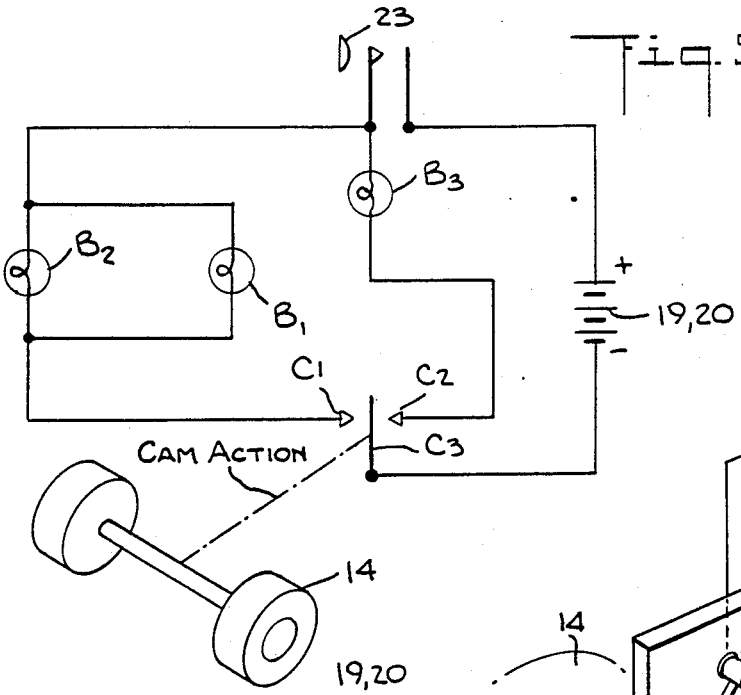
FIG. 5 is a schematic circuit diagram of the lights and the switches.

1. First Embodiment:

Referring now to FIGS. 1 to 2, there is shown a hand-propelled toy vehicle in accordance with the invention. The vehicle, which is preferably molded of synthetic plastic material is in an airplane format and includes a fuselage 10, a propeller 11, a cockpit 12 occupied by a pilot 13, a front wheel set 14 and a rear wheel set 15.

The toy plane further includes left and right wings 16 and 17 which are hinged to fuselage 10 and a handle 18 at the rear of the fuselage which may be grasped by a player to propel the vehicle. Mounted within fuselage 10 is a flashlight bulb $B_1$, which when activated illuminates a translucent fuselage section 10T. Placed within translucent wing tip sections 16T and 17T are flashlight bulbs $B_2$ and $B_3$, respectively. These bulbs are powered by a pair of batteries 19 and 20 housed in a battery compartment 21 formed in the underbody of the plane and closed by a removable cover 22.

The inner wall of handle 18 is corrugated to define a finger grip for the player and is provided with a spring-biased trigger 23 which when squeezed by the player actuates a handle switch 24. As shown separately in FIG. 3, this switch is constituted by a flat metal spring **24*a* and a V-shaped metal spring 24*b* which are normally separated and which are deflected and interconnected when trigger 23 is pressed in. Spring 24*a* normally maintains trigger 23** at its inactive position.

Figure 4:
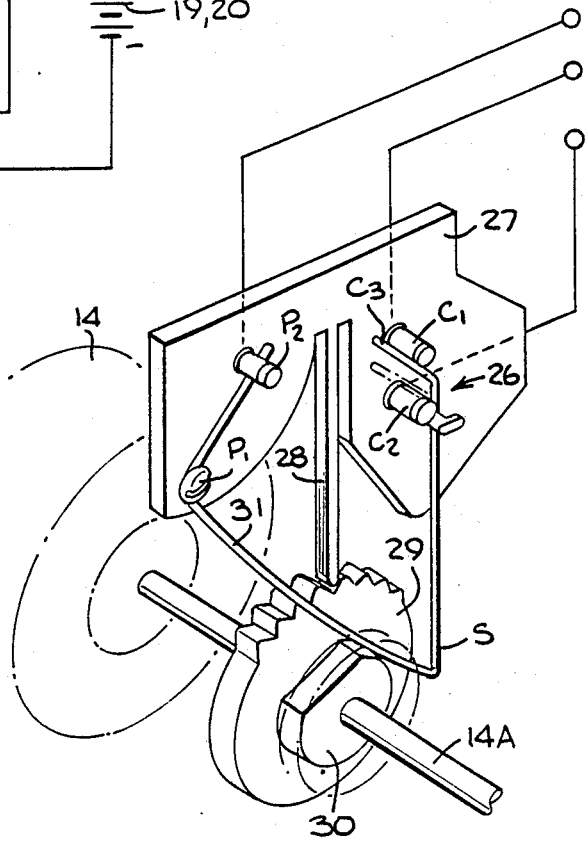
FIG. 4 illustrates the interrupter switch and the actuating mechanism therefor.

As shown in FIG. 4, the axle 14A of front wheel set 14 is operatively coupled by a cam mechanism, to be later described, to a single pole, double-throw interrupter switch 26 having fixed contacts $C_1$ and $C_2$ on opposite sides of a movable contact $C_3$. The fixed contacts are anchored on an insulating plate 27 supported within the body of the plane.

Plate 27, which is formed of flexible plastic material, is contoured to define a flexible tine 28. This tine engages the teeth of a gear 29 mounted on axle 14 of the front wheel set so that as the wheels roll, tine 28 is repeatedly deflected by the teeth of the gear at a rate that depends on the rotary speed of the wheels to produce a clicking sound simulating the noise of an internal combustion engine. Thus, if the vehicle is propelled at a slow speed, the sound will be a rat-a-tat noise at a low repetition rate, which rates increases as the vehicle is propelled to run faster.

Also mounted on axle **14*a* adjacent gear 29 is a step cam 30 which engages the V-shaped section S of a resilient metal wire 31. One end of this wire is supported by pins $P_1$ and $P_2$ anchored on plate 27, the other end of the wire section terminating in switch contact $C_3$. The V-shaped section S rides on cam 30** and as the wheel axle turns is caused to periodically raise and lower contact $C_3$ to alternately engage fixed contacts $C_1$ and $C_2$.

FIG. 5 schematically shows the connections of handle switch 24, interrupter switch 26 with fuselage bulb $B_l$, and wing tip bulbs $B_2$ and $B_3$. It will be seen that the positive terminal of the battery power supply 19, 20 is connected through handle switch 24 in series with parallel bulbs $B_1$ and $B_2$ to fixed contact $C_1$ of interrupter switch 26. The positive terminal is also connected through handle switch 24 in series with bulb $B_3$ to fixed contact $C_2$ of interrupter switch 26. The movable contact $C_3$ of this switch is connected to the negative terminal of the power supply. Hence no bulb is turned on unless handle switch 24 is closed and interrupter switch 26 is closed, either by way of contact $C_1$ or $C_2$.

Initially, movable contact $C_3$ is in engagement with either one of the fixed contacts $C_1$ or $C_2$. Assuming that contact $C_1$ is initially engaged when a player grasps the handle of the toy and squeezes trigger 23 to close handle switch 24, then bulbs $B_1$ and $B_2$ will be simultaneously energized through engaged contact $C_1$ of the interrupter switch, and these bulbs will remain lit continuously as long as switch 24 is closed. Thus, simply holding the toy and squeezing the trigger will cause both light bulbs $B_1$ and $B_2$ to turn on. But should fixed contact $C_2$ be initially engaged, then only light bulb $B_3$ will be caused to turn on.

But when the toy is propelled by a player squeezing the trigger, then the rolling front wheels will through the cam action mechanism act to operate interrupter switch 26 alternately to activate bulbs $B_1$, $B_2$ and $B_3$ so that these bulbs then proceed to blink at a rate depending on how fast the vehicle is going. This blinking action is accompanied by the motor noise generated by the vibrating tine, the rate of vibration being synchronized with the blinking rate.

Thus, the pre-school player, despite the simplicity of the toy and the absence of the need to wind it up or carry out other control functions, is afforded varied play effects; for the moment he grasps the handle and squeezes the trigger, this action produces a light to signal, as it were, the pilot's response to the player that he is ready to take off. And when the player then proceeds to pilot the vehicle along the ground, then the lights begin to blink and motor noise is generated in a way that reflects the effort being exerted by the very young player-pilot.

Figure 6:
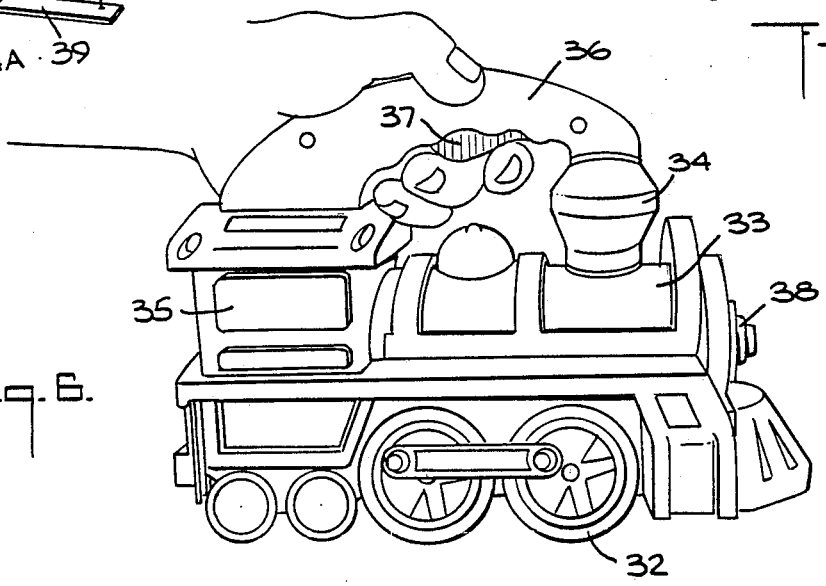
FIG. 6 shows a second embodiment in a toy locomotive format.

2. Second Embodiment:

The toy locomotive shown in FIG. 6 incorporates essentially the same light and sound features included in the first embodiment. This locomotive includes a front set of wheels 32, a boiler 33, smokestack 34 and a cab 35 as well as a handle 36 provided with a trigger 37 which when squeezed actuates a handle switch to turn on at least one light bulb.

The locomotive is provided with a light bulb in its headlight 38, and sections of the locomotive, such as the cab and smokestack, are formed of translucent material behind which are light bulbs. The front wheels are operatively coupled to an interrupter switch in the manner disclosed in the first embodiment to provide a blinking light action as well as an engine-like sound.

It will be appreciated that the same light and sound features may be incorporated in various self-propelled toy vehicles having a handle, such as toy boats provided with wheels and a handle, toy buses and trucks, toy helicopters and other vehicular forms.

3. Alternative Interrupter Switch Arrangement:

In the interrupter switch arrangement shown in FIGS. 4 and 5, movable contact $C_3$ is caused by the action of cam 30 on wheel axle 14A to alternately engage fixed contacts $C_1$ and $C_2$. As a result, contact $C_3$ momentarily occupies a position between contact $C_1$ and $C_2$ and engages neither contact. This represents a small dead spot, for then none of the bulbs will be energized.

Figure 7:
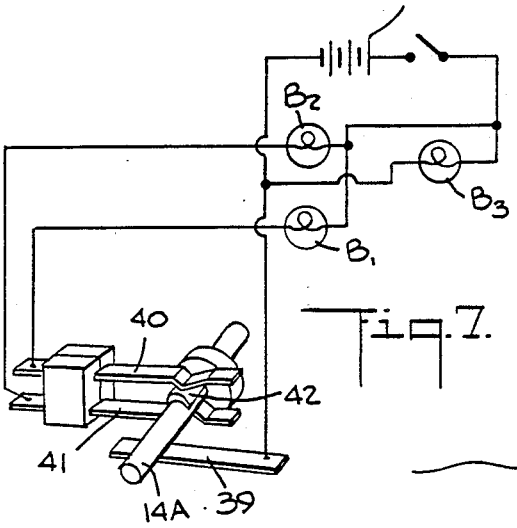
FIG. 7 is a schematic circuit diagram of another interrupter switch and actuating mechanism therefor.

To avoid a dead spot, in the arrangement shown in FIG. 7, the conductive metal axle 14A is permanently engaged by a flat spring contact 39 connected to the negative terminal of battery supply 19, 20. The positive battery terminal is connected through handle switch 24 to one end of bulbs $B_1$, $B_2$ and $B_3$. The other end of bulb $B_3$ is directly connected to the negative terminal of the battery supply. Hence when handle switch 24 is closed, bulb $B_3$ is turned on continuously.

In this instance, the interrupter switch makes use of two spring contacts 40 and 41 disposed on opposite sides of wheel axle 14A. The axle is provided with an insulation cam segment 42 which, as the axle turns, is interposed alternately between the axle and either contact 40 or contact 41. Thus, at any one time, metal axle 14A engages either contact 40 or contact 41, but at no time is the axle disconnected from both contacts.

Contact 40 is connected to the other end of bulb $B_1$. Hence when handle switch 24 is closed, power is supplied to bulb $B_1$ through contact 40, axle 14A and contact 39, but only when insulating cam segment 42 is not interposed between axle 14A and contact 40.

Contact 42 is connected to the other en of bulb $B_2$. Hence when handle switch 24 is closed, power is supplied to bulb $B_2$ through contact 41, axle 14A and contact 39, but only when insulating cam 42 is not interposed between axle 4A and contact 41.

In operation, therefore, when the player grasps the handle of the toy (whether in an airplane, a locomotive or any other format), and in doing so closes handle switch 24, this action will cause bulb $B_3$ to turn on, and also turn on either bulb $B_1$ or $B_2$, depending on which one of contacts 40 and 42 is then electrically engaged with axle 14A.

Then as the toy vehicle is propelled by the player and axle 14A is caused to rotate, bulbs $B_1$ and $B_2$ will turn on alternately to provide a blinking light effect, bulb $B_3$ remaining on continuously. There is no dead spot in this arrangement, for at no time are all bulbs turned off when handle switch 24 is closed. The location of bulbs $B_1$, $B_2$ and $B_3$ in the toy is a design consideration and depends on the nature of the toy.

While there have been shown and described preferred embodiments of a blinking toy vehicle in accordance with the invention, it will be appreciated that many changes and modifications may be made therein without, however, departing from the essential spirit thereof.

We claim:

1. A hand-propelled toy vehicle having a body and provided with a battery power supply, a set of wheels mounted on an axle and a U-shaped handle whose ends are secured to the body, the handle to be grasped by a player to propel the vehicle along a playing surface, said vehicle comprising:

(a) a trigger-actuated, spring loaded, normally open switch mounted on an inner surface of the handle, the switch being closed by the player when grasping the handle and in doing so squeezing the trigger;

(b) an interrupter switch operatively coupled to the axle, whereby as the axle rotates, this switch is periodically opened and closed at a rate that depends on the speed of rotation;

(c) at least first and second light bulbs disposed in the vehicle; and (d) circuit means connecting the first bulb through the handle switch in parallel with the interrupter switch to said supply and also connecting said second bulb through the handle switch in series with the interrupter switch to said supply, whereby when a player actuates the handle switch and the interrupter switch is then closed but the vehicle is not yet being propelled, the first bulb is then turned on, and when the vehicle is thereafter propelled by the handle, the second bulb is turned on intermittently to produce a blinking light action, neither bulb being turned on when the handle is not grasped by the player.

2. A toy vehicle as set forth in claim 1, wherein said interrupter switch has a movable contact that is operatively coupled to the axle by means of a cam mounted on the axle which, as the axle turns, causes the movable contact to periodically engage a fixed contact to close the switch.

3. A toy vehicle as set forth in claim 2, wherein said interrupter switch includes a pair of fixed contacts on either side of the movable contact, one fixed contact being connected to said first bulb and the other fixed contact to a second bulb, whereby as the axle turns, the first and second bulbs are alternately turned on.

4. A toy vehicle as set forth in claim 3, wherein said vehicle is in an airplane format having wings, and said first and second bulbs are mounted at the tips of the wings.

5. A toy vehicle as set forth in claim 4, wherein said airplane has a translucent fuselage section behind which is mounted a third bulb connected in parallel with the first bulb.

6. A toy vehicle as set forth in claim 1, wherein said handle switch is formed by a pair of normally parallel, flat metal springs, one of which is deflected by the squeezed trigger into engagement with the other spring.

7. A toy vehicle as set forth in claim 1, wherein said vehicle body is in a locomotive format having a headlight opening associated with one of said light bulbs.

8. A toy vehicle as set forth in claim 2, wherein the fixed contact is mounted on an insulating plate of flexible material which is contoured to define a tine, said tine engaging the teeth of a gear mounted on the axle adjacent the cam to deflect the tine periodically as the axle rotates to produce an engine noise.

9. A toy vehicle as set forth in claim 1, further including a third bulb and wherein said axle is formed of conductive metal and is provided with an insulating cam segment and said interrupter switch comprises first and second spring contacts disposed on opposite sides of the axle whereby as the axle rotates the segment thereon is alternately interposed between the axle and one of the contacts, the other contact then electrically engaging the axle, the first contact being connected through the second bulb and the handle switch to one terminal of the supply, the second contact being connected through the third bulb and the handle switch to said one terminal of the supply whose other terminal is connected to a third spring contact which permanently engages the axle, whereby when the handle switch is closed said first bulb is then engaged, and when the vehicle is thereafter propelled, the second and third bulbs are alternately energized.

* * * * *